US005759137A

United States Patent [19]

Huang

[11] Patent Number: 5,759,137

[45] Date of Patent: Jun. 2, 1998

[54] MULTIFUNCTIONAL TRAINING MACHINE

[75] Inventor: Kou-Ming Huang, Taichung, Taiwan

[73] Assignee: Chililon Enterprise Co., Ltd., Taichung, Taiwan

[21] Appl. No.: 779,659

[22] Filed: Jan. 7, 1997

[51] Int. Cl.[6] ..... A63B 69/06; A63B 21/068

[52] U.S. Cl. ..... 482/72; 482/96; 482/142

[58] Field of Search ..... 482/72, 130, 142, 482/907, 96

[56] References Cited

U.S. PATENT DOCUMENTS

| | | | |
|---|---|---|---|
| 4,756,523 | 7/1988 | Rasmussen | 482/142 X |
| 5,108,090 | 4/1992 | Reed | 482/907 X |
| 5,215,511 | 6/1993 | Cheng | 482/142 X |
| 5,330,404 | 7/1994 | Lopeteguy | 482/142 |
| 5,453,066 | 9/1995 | Richter | 482/96 |
| 5,531,658 | 7/1996 | L.S.C. | 482/142 |

*Primary Examiner*—Richard J. Apley
*Assistant Examiner*—William LaMarca
*Attorney, Agent, or Firm*—Pro-Techtor International

[57] ABSTRACT

A multifunctional training machine, that includes: a frame; a device for bending the user's body upward from a lying position, a seat, mounted on the frame a back rest, hingedly mounted on the seat and being raisable and lowerable, a gliding frame, glidingly mounted on the frame in front of the seat and movable back and forth and having two foot rests, and a transmission mechanism, connected to the gliding frame and the back rest and transforming the longitudinal movement of the gliding frame into raising or lowering of the back rest; a hip support for stretching the hips of the user, mounted between the seat and the back rest, close to the back edge of the seat, the hip support being vertically movable, so as to raise the hips of the user above the seat; and a pull bar, connected to the foot rests, for pulling up the foot rests, while the user presses in a contrary effort the feet on the foot rests; wherein the user can perform the exercises of bending the body upward from a lying position, stretching the hips, and stretching the feet.

13 Claims, 11 Drawing Sheets

MULTIFUNCTIONAL TRAINING MACHINE

BACKGROUND OF THE INVENTION

1. Field of the Invention

The present invention relates to a multifunctional training machine, particularly to a multifunctional training machine for indoor use on a floor.

2. Description of Related Art

Modern living conditions, with their hectic pace and a lack of open space, provide little opportunity for physical exercise. So city dwellers increasingly perform physical exercises indoors, on training machines. Together with a recent awareness of the importance of health and beauty a certain demand for indoor training machines has been created.

Among traditional indoor training machines, the most popular machines for bending the body upward from a lying position only include a bench and a hold for the feet. This kind of machines help to train bending the body upward from a lying position, but do not provide other options for exercises. For rehabilitation and training the body of physically impaired persons a wider range of options is needed, which is not provided by conventional training machines.

SUMMARY OF THE INVENTION

An object of the present invention is to provide a multifunctional training machine, which trains the strength of the abdominal muscles in coordination with the whole body.

Another object of the present invention is to provide a multifunctional training machine, which trains stretching the hips.

A further object of the present invention is to provide a multifunctional training machine, which trains stretching the feet.

A further object of the present invention is to provide a multifunctional training machine, which aids physical rehabilitation.

The present invention can be more fully understood by reference to the following description and accompanying drawings.

DETAILED DESCRIPTION OF THE PREFERRED EMBODIMENTS

Figure 1:
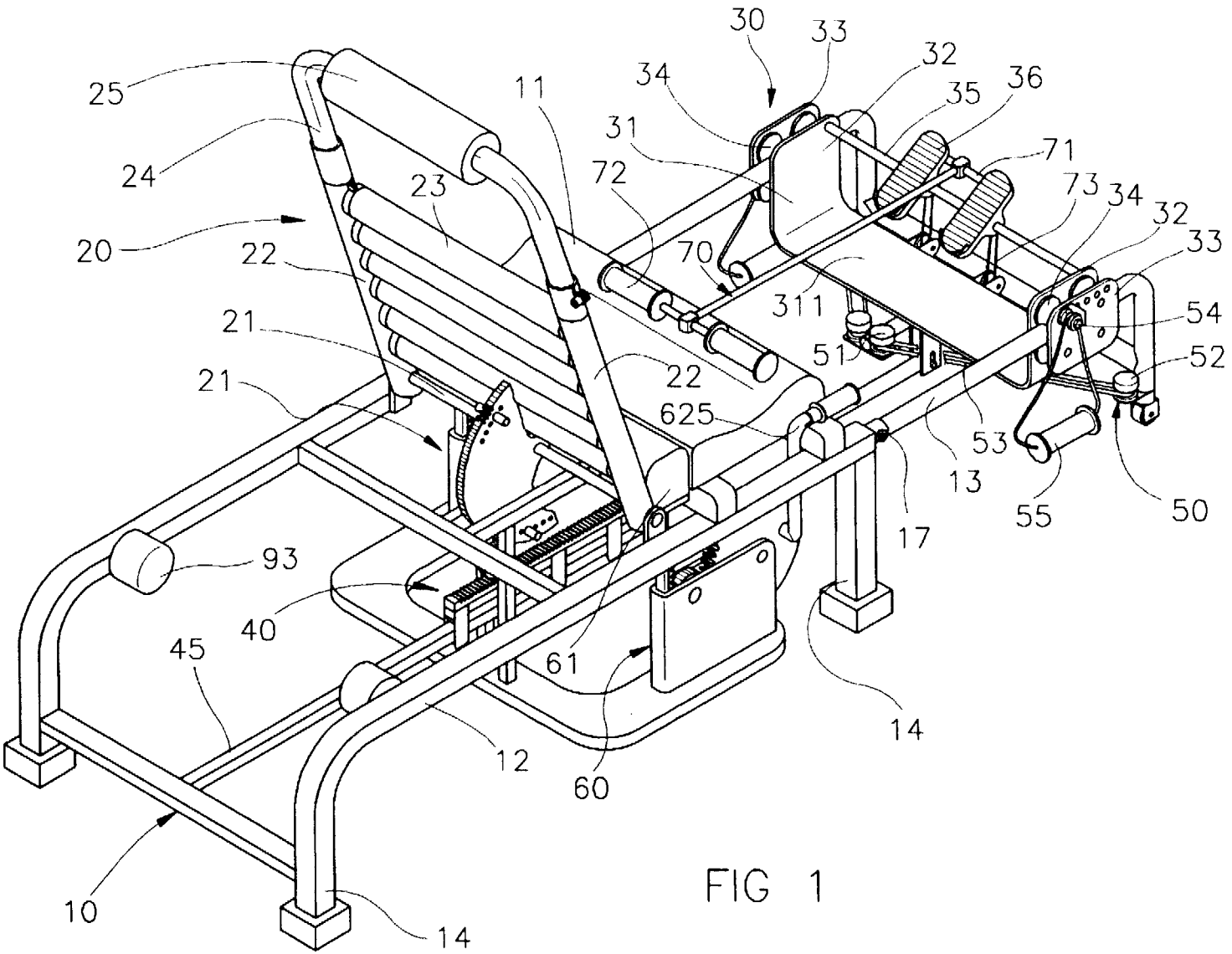
FIG. 1 is a perspective view of the multifunctional training machine of the present invention.

As shown in FIG. 1, the multifunctional training machine of this invention is usable for bending the body upward from a lying position, for stretching the hips and stretching the feet. The parts for bending the body upward from a lying position mainly comprise: a frame 10; a seat 11 for the user, which is mounted on the frame 10; a back rest 20, hingedly mounted on the seat 11 and connected to the seat 11 by a shaft 21; a gliding frame 30, which is mounted on the frame 10 in front of the seat 11, gliding back and forth; and a transmission mechanism 40, connecting the gliding frame 30 and the back rest 20, such that the back rest is lowered and raised with the shaft 21 as a hinge, as driven by the gliding frame 30.

Figure 2:
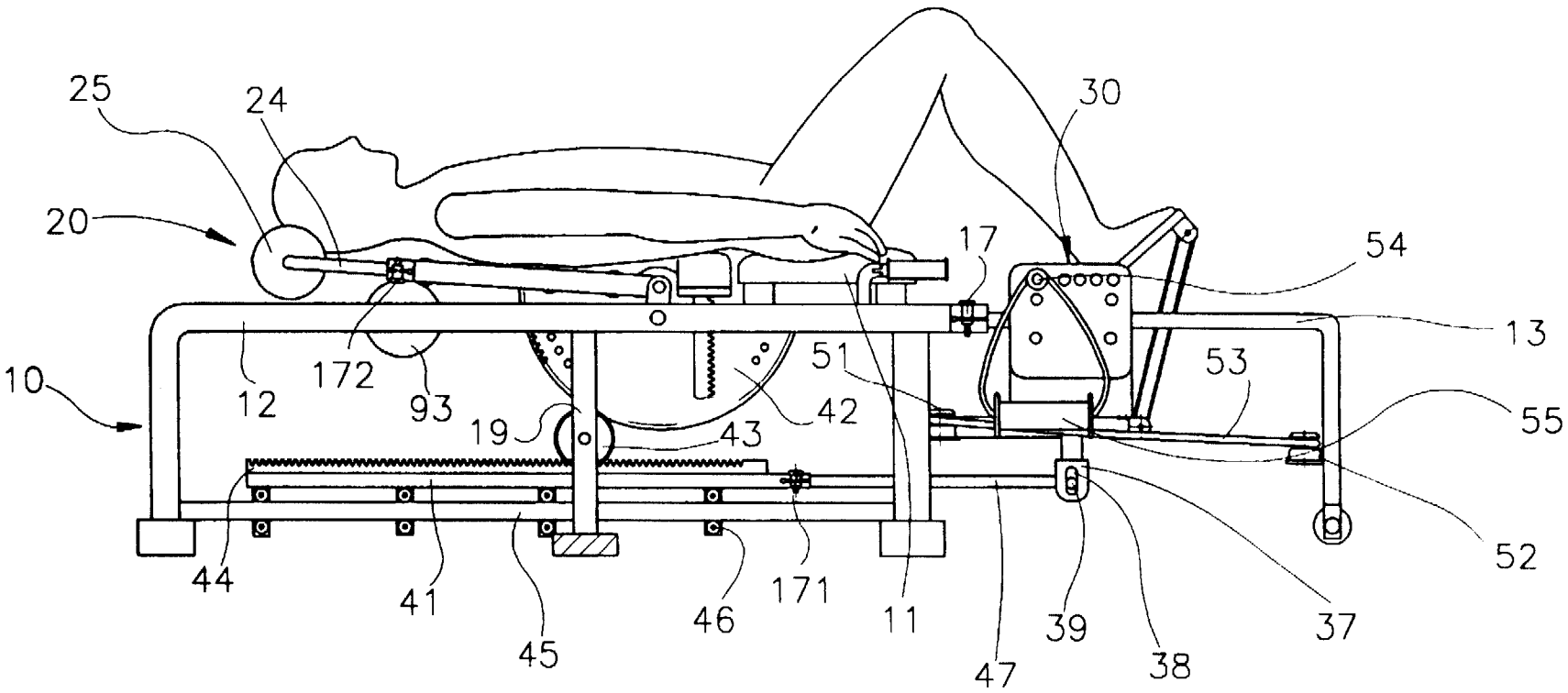
FIG. 2 and 3 are schematic illustrations uf the use of the present invention for bending the body upward from a lying position.
Figure 3:
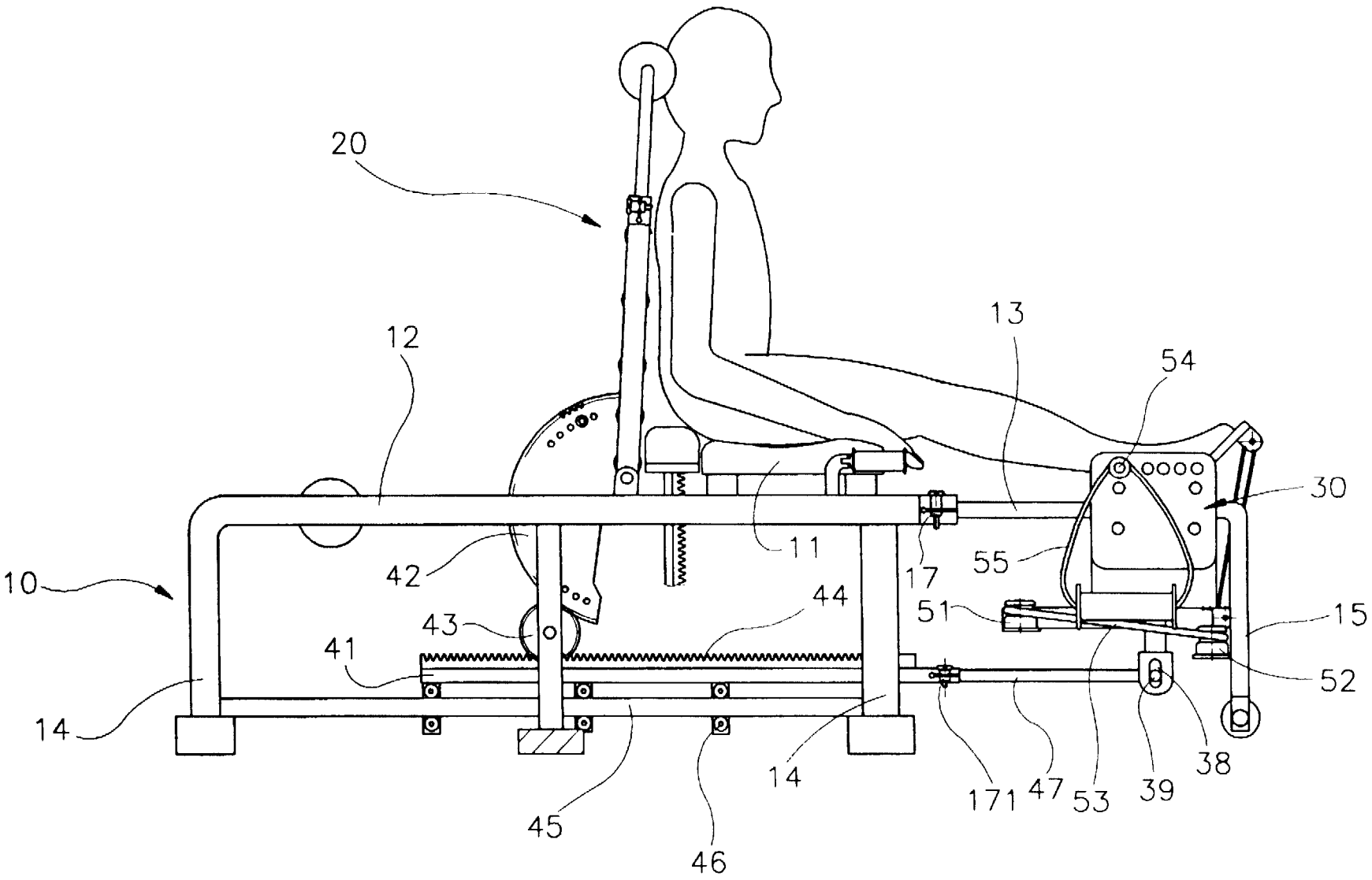

As shown in FIGS. 2 and 3, when the multifunctional training machine of this invention is used for bending the body upward from a lying position, the upper half of the user's body rests on the back rest 20, the back rest 20 being lowered to a horizontal position. The user's feet step on the gliding frame 30. By the pressure of the feet against the gliding frame 30 and by way of the transmission mechanism 40, the back rest 20 is raised. At the same time, the user raises the upper half of his body from the back rest 20, thereby training the abdominal muscles.

Referring to FIG. 1, the frame 10 has roughly a rectangular plan and is made of tubes. The frame 10 has on both longitudinal sides two lateral tubes 12, to which a plurality of feet 14 are attached. On the front end each of the lateral tubes 12 has a glide tube 13 as a straight continuation. The two glide tubes 13 guide the movement of the gliding frame 30. The glide tubes 13 are inserted into the lateral tubes 12 from the front end with variable depth. They are locked by pipe clamps 17 in a position that allows the user to stretch his legs straight out, when seated on the seat 11, stepping on the gliding frame 30. The glide tubes 13 each have a foot 15 as a support. Each foot 15 has a wheel 16 for easily moving the gliding tubes 13 forward and backward on the floor.

As shown in FIGS. 1 and 2, the gliding frame 30 has a base support 31, shaped like the letter U. A base plate 311 forms the lower horizontal part of the base support 31. Two side plates 32 form the vertical parts to the ends of the base plate 311. The side plates 32 are located inside the two glide tubes 13, close to the glide tubes 13. Two fixing plates 33 on the outside of the glide tubes 13 are attached to the side plates 32. The gliding frame 30 is supported by the two glide tubes 13, resting on wheels 34, which are on both sides located in the spaces between the side plates 32 and the fixing plates 33. Thus the gliding frame 30 is easily moved back and forth on the glide tubes 13. The two side plates 32 are connected by a transversal rod 35, which carries two foot rests 36. The foot rests 36 support the feet of the user in their full length, their upper ends being movable up and down. When using the multifunctional training machine of this invention, the user places his feet on the foot rests 36.

Figure 4:
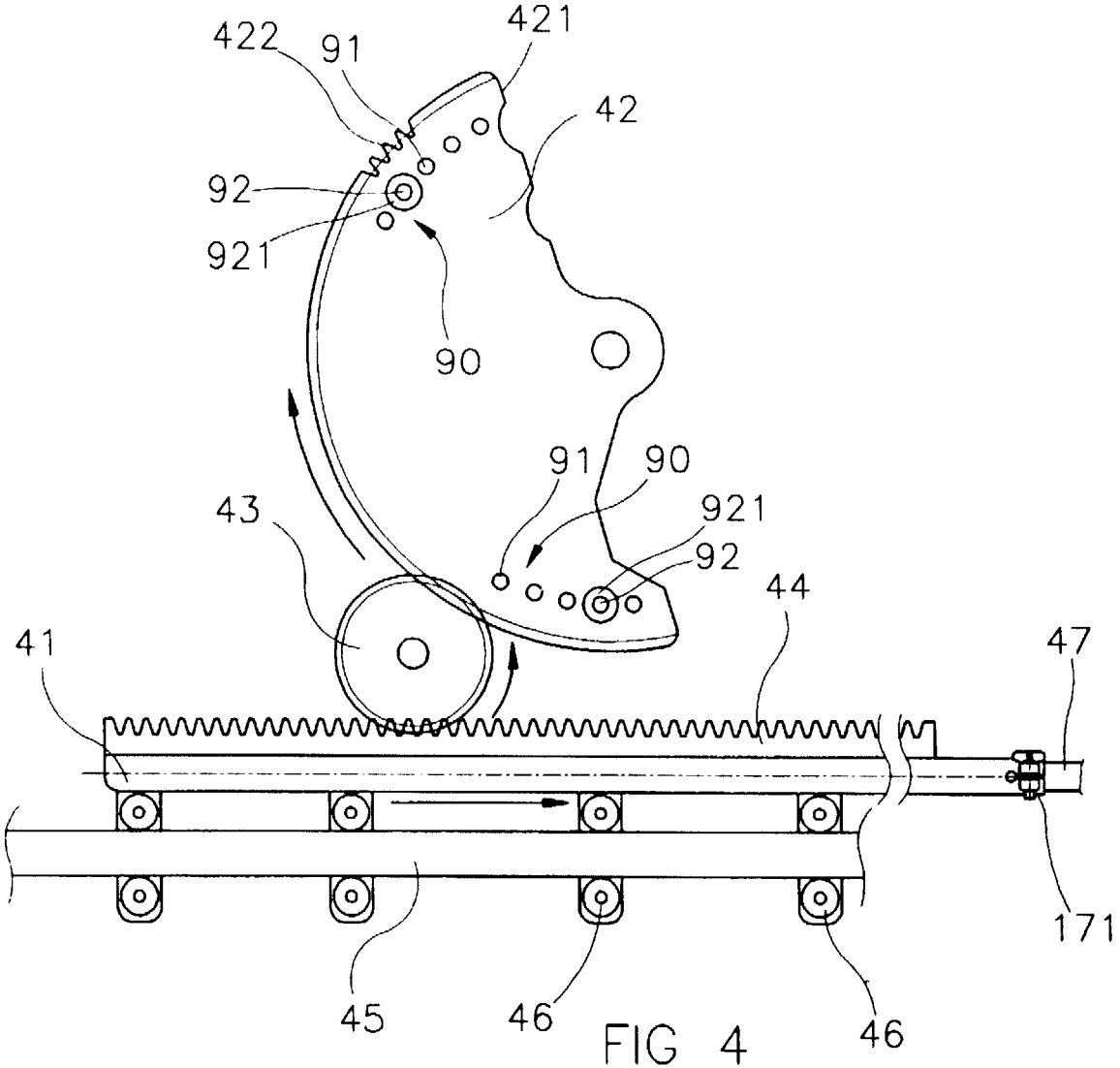
FIG. 4 is a side view of the driving mechanism used when bending the body upward from a lying position.

As shown in FIGS. 2 and 4, the transmission mechanism 40 has a transmission rod 41. The transmission rod 41 is a tube, the front end of which has a rod extension 47 as straight continuation. The rod extension 47 is inserted into the front end of the transmission rod 41 with variable depth.

The front end of the rod extension 47 is connected to the lower side of the gliding frame 30. The back end of the transmission rod 41 reaches towards the back end of the frame 10. The transmission rod 41 and the rod extension 47 are attached to each other by a pipe clamp 171. To adjust the position of the gliding frame 30, the pipe clamp 171 is loosened, the rod extension 47 pulled out or pushed in, and the pipe clamp 171 is fastened again. In the embodiment described here, a horizontal rack 44 is attached to the transmission rod 41, with the cogs of the rack 44 pointing upwards. A pinion 43 is mounted above the rack 44, supported by a T-shaped inner frame 19, which is attached to the frame 10.

The cogs of the pinion 43 engage with the cogs of the rack 44. Further above, a gear 42 is mounted, shaped as a disc sector 421. The gear 42 is attached to the back rest 20 and shares a common rotational axis with the shaft 41. So rotating the gear 42 lowers or raises the back rest 20. The cogs 422 of the gear 42 engage with the cogs of the pinion 43. Thereby, lowering or raising the back rest 20 is driven by rotating the pinion 43, which is in turn driven by the longitudinal movement of the transmission rod 41 and the rack 44 attached to it. When the user pushes the gliding frame 30 towards the front end of the glide tubes 13, the rod extension 47 along with the transmission rod 41 are driven forward, and the back rest 20 is raised. Accordingly, when the user pulls back the gliding frame 30, the back rest is lowered.

The transmission rod 41 is supported by a guiding bar 45, which is attached to the frame 10. Between the transmission rod 41 and the guiding bar 45 several guiding wheels 46 are inserted, guiding the longitudinal movement of the transmission rod 41 on the guiding bar 45 and minimizing friction.

On the gear 42, close to the periphery thereof, two angular limiters 90 are provided, in an upper and a lower position. Each angular limiter 90 comprises a plurality of holes 91, bored through the gear parallel to the axis thereof and arranged along the periphery thereof, and a bolt 92, which is inserted into one of the holes 91.

Furthermore, absorber elements 921 are put on the free ends of the bolts 92. When the back rest 20 is lowered by turning the gear 42, the upper angular limiter 90 moves against the inner frame 19 from above. At a certain angular position of the gear 42 the bolt 92 of the upper angular limiter 90 bumps against the inner frame 19, preventing further lowering the back rest 20. When the back rest 20 is raised by turning the gear 42 the other way, the lower angular limiter 90 moves against the inner frame 19 from below. At a certain angular position of the gear 42 the bolt 92 of the lower angular limiter 90 bumps against the inner frame 19, preventing further raising the back rest 20. Thus the angular movement of the gear 42 is restricted. The angular range is determined by inserting the bolts 92 into certain holes 91. The absorbing elements 921 dampen the shock of the bolts 92 bumping against the inner frame 19. Additionally, two absorbers 93 are attached to the lateral tubes 12. When the back rest 20 is lowered to a horizontal position, it hits the absorbers 93. Thus a hard collision with the frame 10 or other parts is prevented.

As shown in FIGS. 1 and 3, the back rest 20 has two parallel lateral bars 22, which are tubes and form the right and left edge thereof. For each lateral bar, one end is fixed to the shaft 21, the other end extends upwards away from the shaft 21. Thereby the back rest is lowered and raised by turning the shaft 21. The two lateral bars 22 are connected by several rollers 23. When the user bends the body upward from a lying position, his back glides over the back rest 20. Then the rollers 23 minimize friction between the user's back and the back rest 20 and at the same time massage the user's back. Some of the rollers 23 lean against the disc sector 421 of the gear 42. The upper ends of the lateral bars 22 are connected by an upper bar 24, which is shaped like the letter U turned upside-down. The upper bar 24 has a horizontal section, around which a head rest 25 is put. Each end of the upper bar 24 is inserted into the upper end of one of the lateral bars 22, the insertion depth being variable, in order to adjust for the statue of the user. The desired position of the upper bar 24 is fixed by two pipe clamps 172 on both ends of the upper bar 24.

As shown in FIGS. 2 and 3, from the bottom side of the gliding frame 30 two parallel wing plates 37 extend vertically downwards. The two wing plates 37 are placed to the right and left of each other. Both wing plates 37 have vertically elongated holes 38, which are aligned. A crossbar 39 is inserted into both elongated holes 38. The crossbar 39 is attached to the front end of the rod extension 47. The diameter of the crossbar 39 is large enough to allow for no horizontal free space within the elongated holes 38. So any horizontal movement of the gliding frame 30 is directly transmitted to the rod extension 47. At the same time, the vertical extension of the elongated holes 38 accommodates any change in the vertical position of the gliding frame 30 due to adjustments or material changes.

In order to assist the user, when bending the body upward from a lying position, two auxiliary devices 50 are installed close to the front end of the frame 10.

Each of the auxiliary devices 50 comprises a reel 51, attached to the bottom side of the gliding frame 30, a reel 52, attached to the foot 15 of one of the glide tubes 13, and an elastic element 53, connecting the reels 51 and 52. When the gliding frame 30 is moved back, the elastic element 53 is stretched, building up a forward pressure on the gliding frame 30. When the gliding frame 30 is moved forward again, the elastic element 53 assists in this movement, helping to raise the back rest 20 and facilitating the exercise of bending the body upward from a lying position. Furthermore, to the right and left sides of the gliding frame 30 two holders 54 are attached, each holding a loop-shaped string 55 with a handle, allowing the user to assist the upward bending of the body with the arms.

Using the multifunctional training machine of the present invention for bending the body upward from a lying position not only trains the abdominal muscles, but also the cooperation between upper and lower half of the body. So the whole body is trained rather than the upper half of the body, enhancing the training effect of the multifunctional training machine of the present invention, as compared to conventional training machines.

Figure 5:
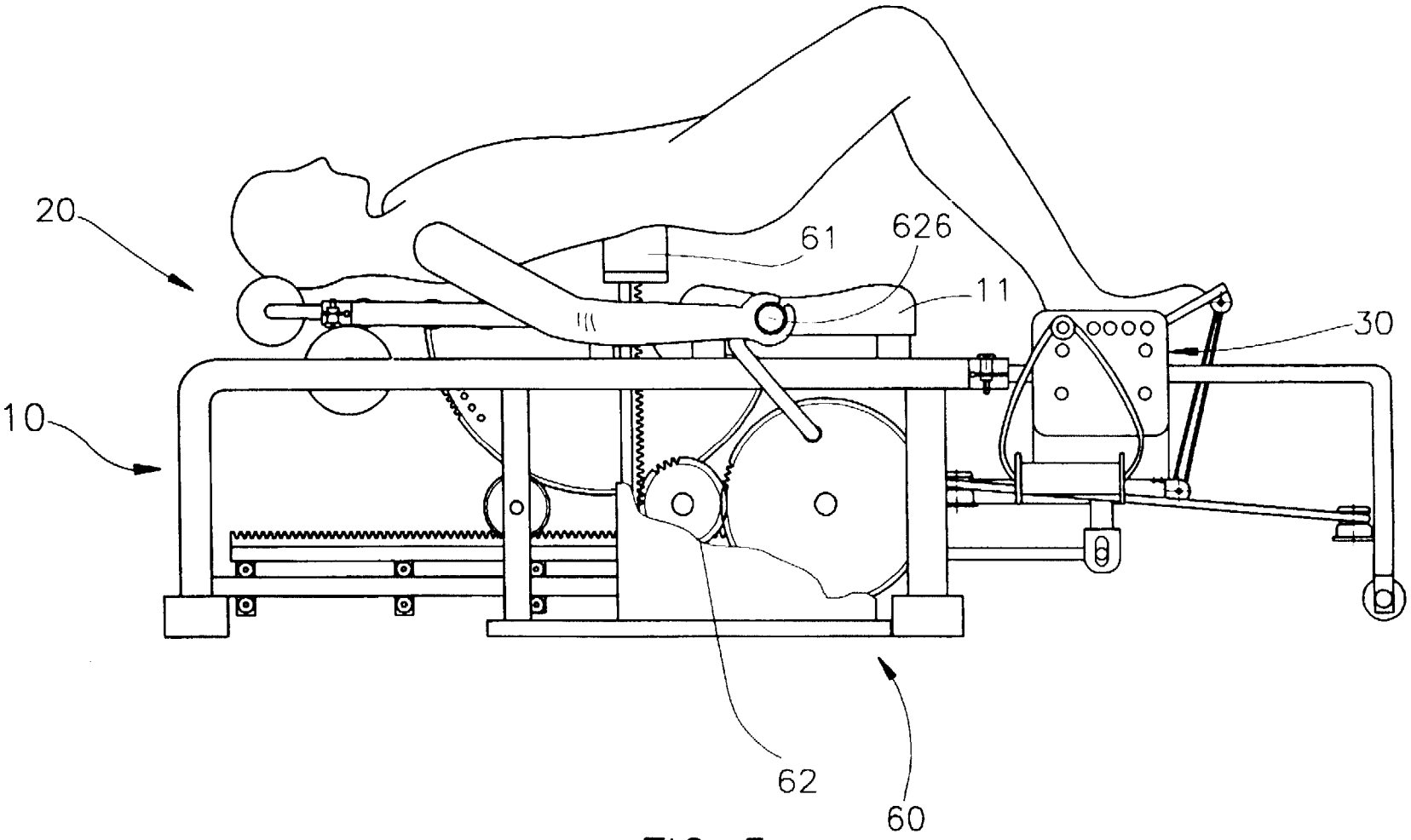
FIG. 5 is a schematic illustrations uf the use of the present invention for stretching the hips.

As shown in FIGS. 1 and 5, the multifunctional training machine of the present invention also trains stretching the hips. For this purpose, a hip support 60 is installed on the frame 10. The hip support 60 is vertically movable, raising and lowering the hips and thus providing a stretching exercise. The hip support 60 comprises a hip rest 61 and two driving systems 62. The hip rest 61 is an elongated solid block, which is located between the seat 11 and the back rest 20, extending from the right edge to the left edge of the seat 11. The lower side of the hip rest 61 is connected to the two driving systems 62. The driving systems 62 drive the vertical up-and-down movement of the hip rest 61. In the lowest position, the hip rest 61 is horizontally aligned with the seat 11. Before raising the hip rest 61, the back rest 20 is lowered to a horizontal position. Then the hip rest 61 is raised by the driving devices 62, providing the stretching exercise for the user's hip.

Figure 6:
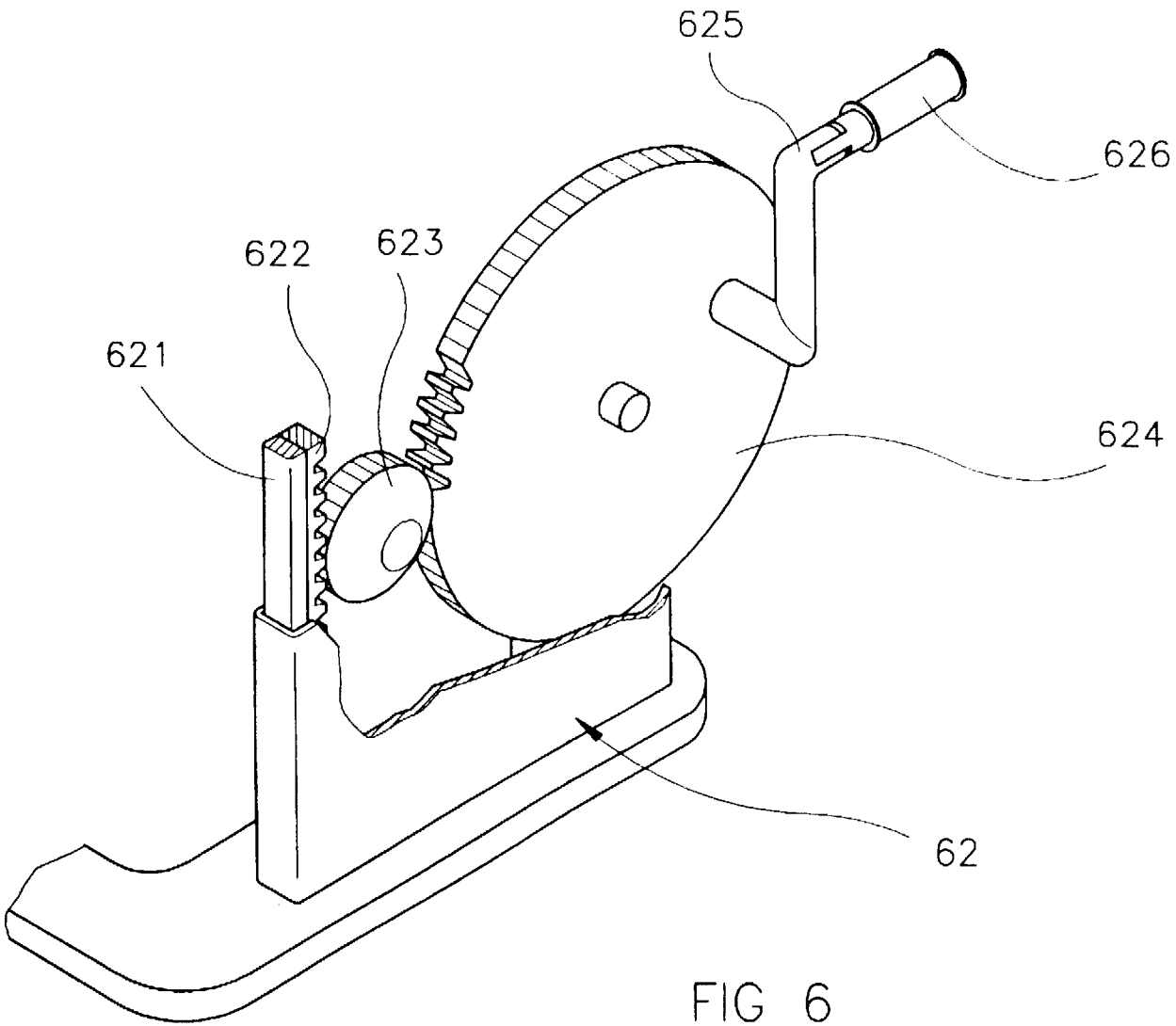
FIG. 6 is a perspective view of the driving mechanism used when stretching the hips.

As shown in FIGS. 5 and 6, the two driving systems 62 are connected to the right end and the left end of the hip rest 61, respectively. For each driving system 62, a vertical rack 621 is provided, the upper end of which supports one end of the hip rest 61. The front side of the rack 621 has teeth 622, which are engaged by a pinion 623. The pinion 623 in turn is engaged by a driving gear 624. So for each driving system 62, the driving gear 624 drives the vertical movement of the rack 621, thus driving the vertical movement of the hip rest 61.

For each driving system 62, the driving gear 624 has a handlebar 625, which is shaped like a crooked bar. One end of the handlebar 625 is attached to the outside of the driving gear 624 close to the periphery thereof. From there, the handlebar 625 extends upwards, with the upper end close to the seat 11. The upper end of the handlebar 625 is bent, forming a handle 626. It can be turned outwards for using the driving system 62 or aligned with the seat 11, when not in use. To raise the hip rest 61, the user grips the handles 626 of both driving systems 62 and pulls them back a far as desired. For this exercise, the connection between the transmission rod 41 and the rod extension 47 has to be loosened by unfastening the pipe clamp 171, in order to prevent inadvertent raising of the back rest 20 by the user, when he presses on the gliding frame 30.

Figure 7:
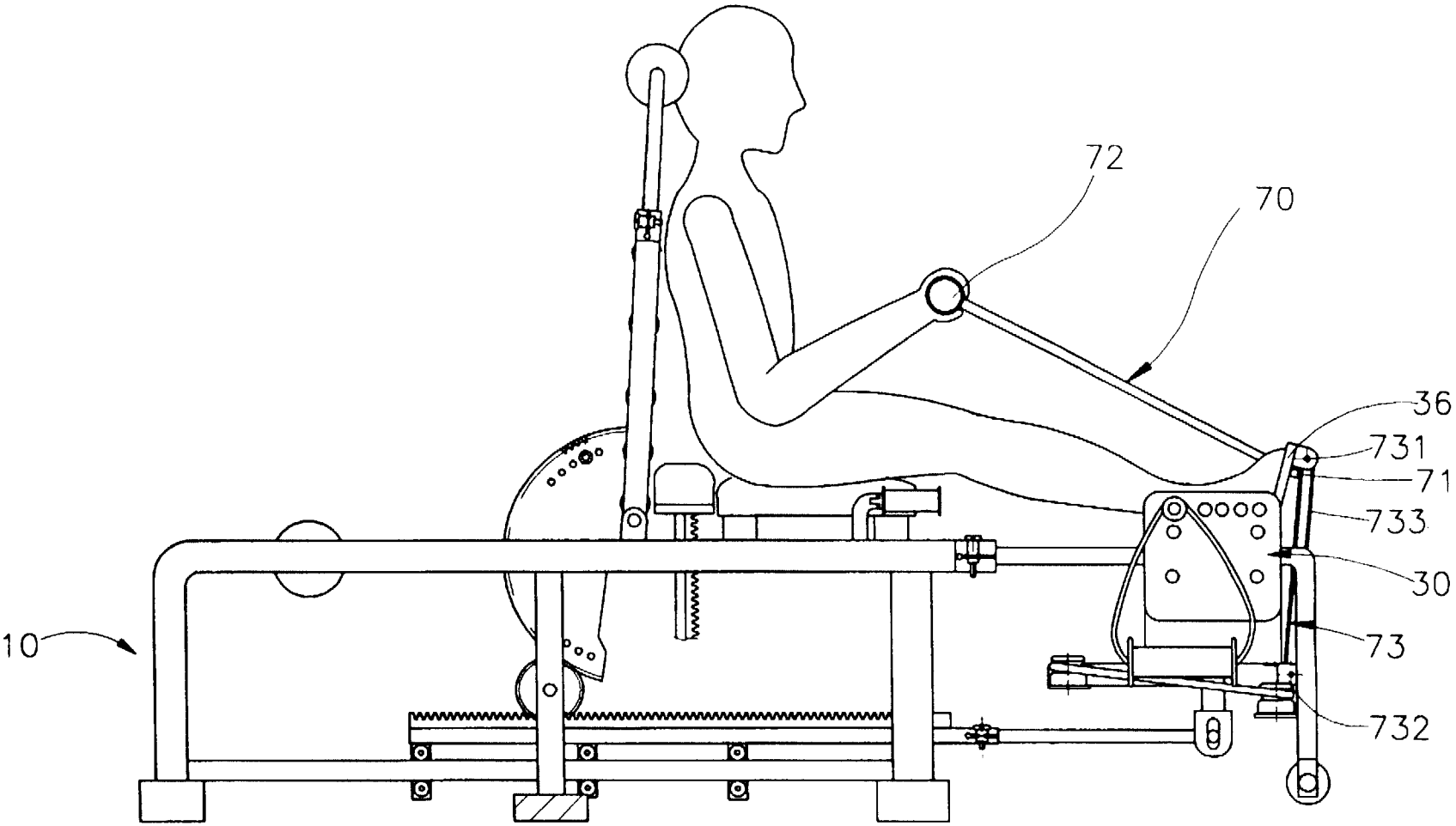
FIG. 7 is a schematic illustrations uf the use of the present invention for stretching the feet.

As shown in FIGS. 1 and 7, the multifunctional training machine of the present invention also trains stretching the feet against resistance. For this exercise, a straight pull bar 70 is provided. One end of the pull bar 70 has a crossbar 71, which is connected to the upper ends of the foot rests 36. The other end of the pull bar 70 has a handlebar 72. The user, holding the handlebar 72, pulls back the pull bar 70, thus raising the upper ends of the foot rests 36. At the same time, he works against this movement, stretching his feet out.

Furthermore, a resetting device 73 is provided for pulling down the upper ends of the foot rests 36. The resetting device comprises a reel 731, which is attached to the crossbar 71, a reel 732, which is attached to the base plate 311 of the gliding frame 30, and an elastic element 733, connecting the reels 731 and 732. Then the user, by pulling back the pull bar 70, raises the upper ends of the foot rests 36, the elastic element 733 is stretched and, by developing a contracting counterforce, helps to return the foot rests 36 into their original position.

Figure 8:
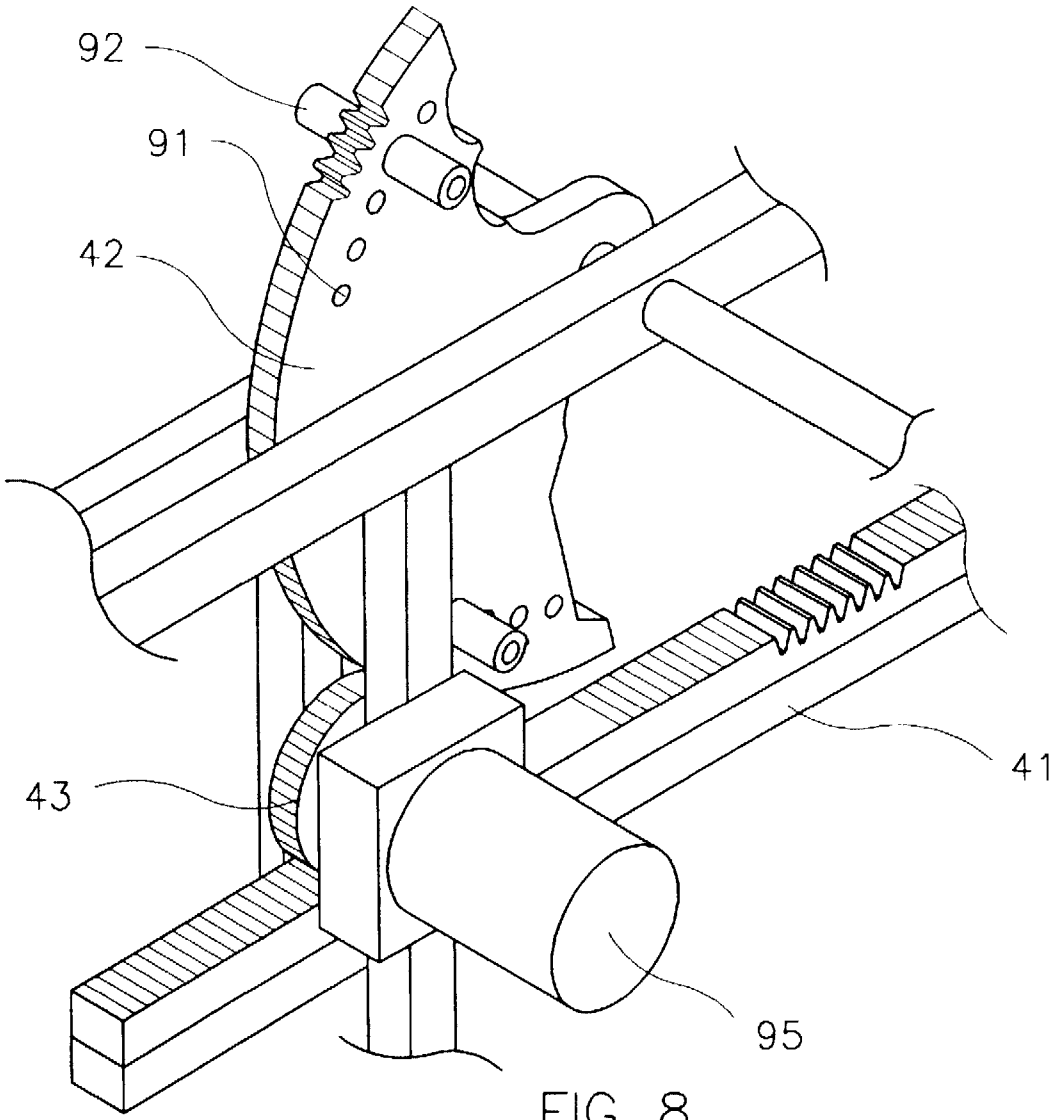
FIG. 8 is a perspective view of the driving mechanism with an additional motor installed, used for bending the body upward from a lying position, in an embodiment for physical rehabilitation.
Figure 9:
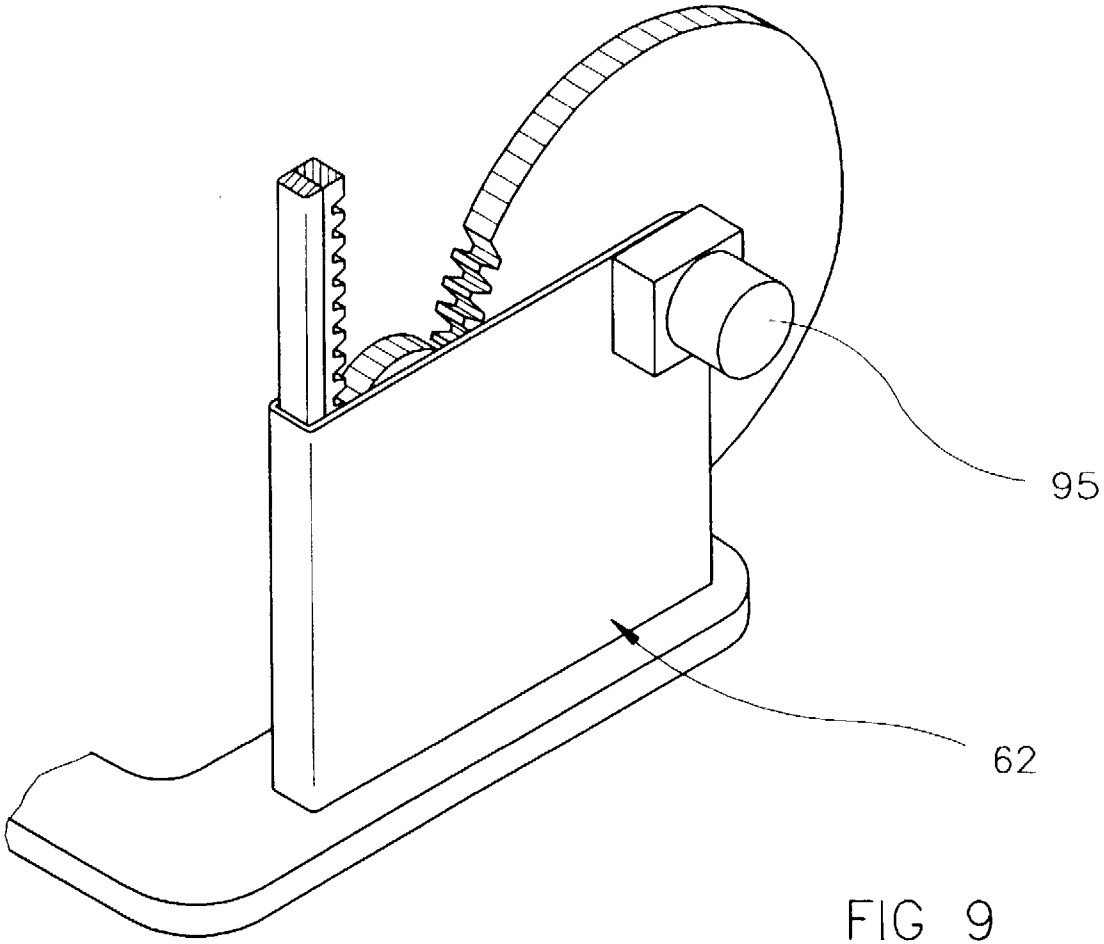
FIG. 9 is a perspective view of the driving mechanism with an additional motor installed, used for stretching the hips, in an embodiment for physical rehabilitation.

Referring to FIGS. 8 and 9, the multifunctional training machine of the present invention in other embodiments is provided with motors, which assist in the exercises for rehabilitation purposes. For assisting the bending of the body upward from a lying position, the transmission mechanism 40 has a motor 95, as shown in FIG. 8. The motor 95 drives the pinion 43, in order to rotate the gear 42 and raise the back rest 20. In another embodiment, for assisting the raising of the hip, the hip support 60 has a motor 95, as shown in FIG. 9. The motor 95 drives the driving system 62.

Figure 10:
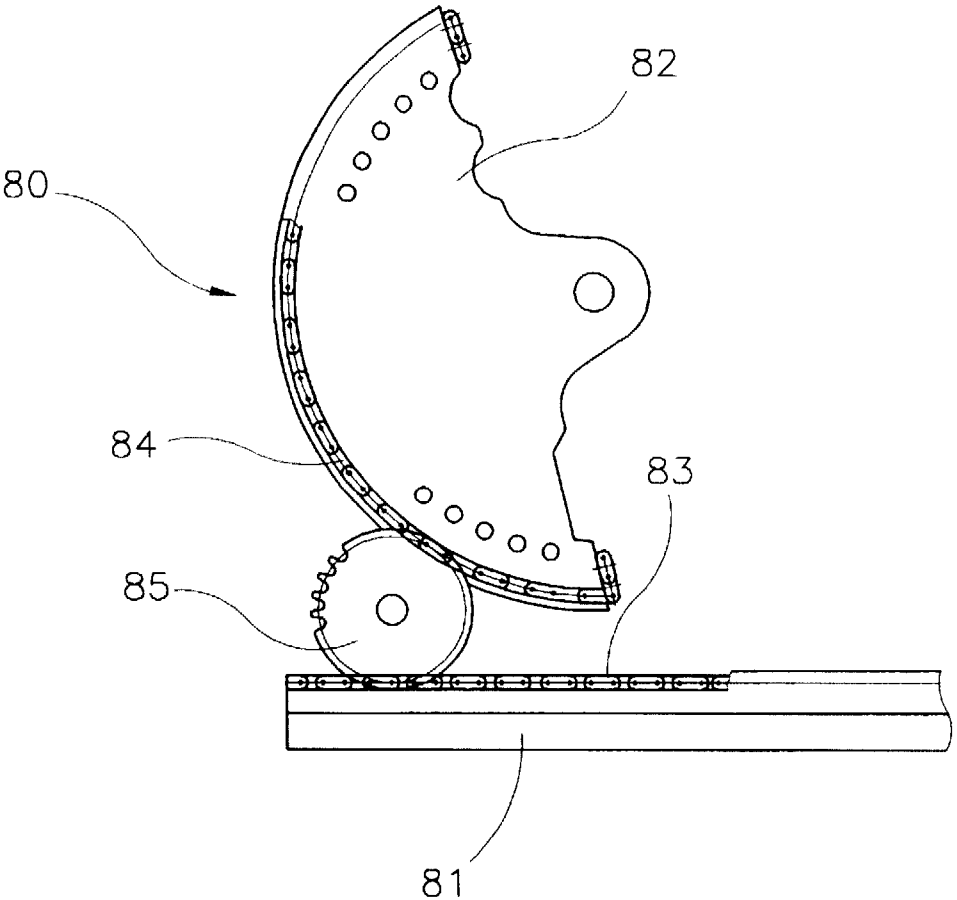
FIG. 10 is a side view of the driving mechanism for bending the body upward from a lying position, in an embodiment of this invention, where a chain has been substituted for gear teeth.

Referring to FIG. 10, in a further embodiment of the present invention, a transmission mechanism 80 is substituted for the transmission mechanism 40. The transmission mechanism 80 comprises a transmission rod 81, which is driven by the gliding frame 30, a wheel sector 82, which is attached to the back rest 20, and a pinion 85. A chain 83 is stretched out along the upper side of the transmission rod 81, and a chain 84 is stretched out along the periphery of the wheel sector 82. The pinion 85 engages both with the chain 83 of the transmission rod 81 and with the chain 84 of the wheel sector 82. Thereby the longitudinal movement of the transmission rod 81 leads to the raising or lowering of the back rest 20. This embodiment has the advantage of low noise and little vibration, when the back rest 20 is raised or lowered.

Figure 11:
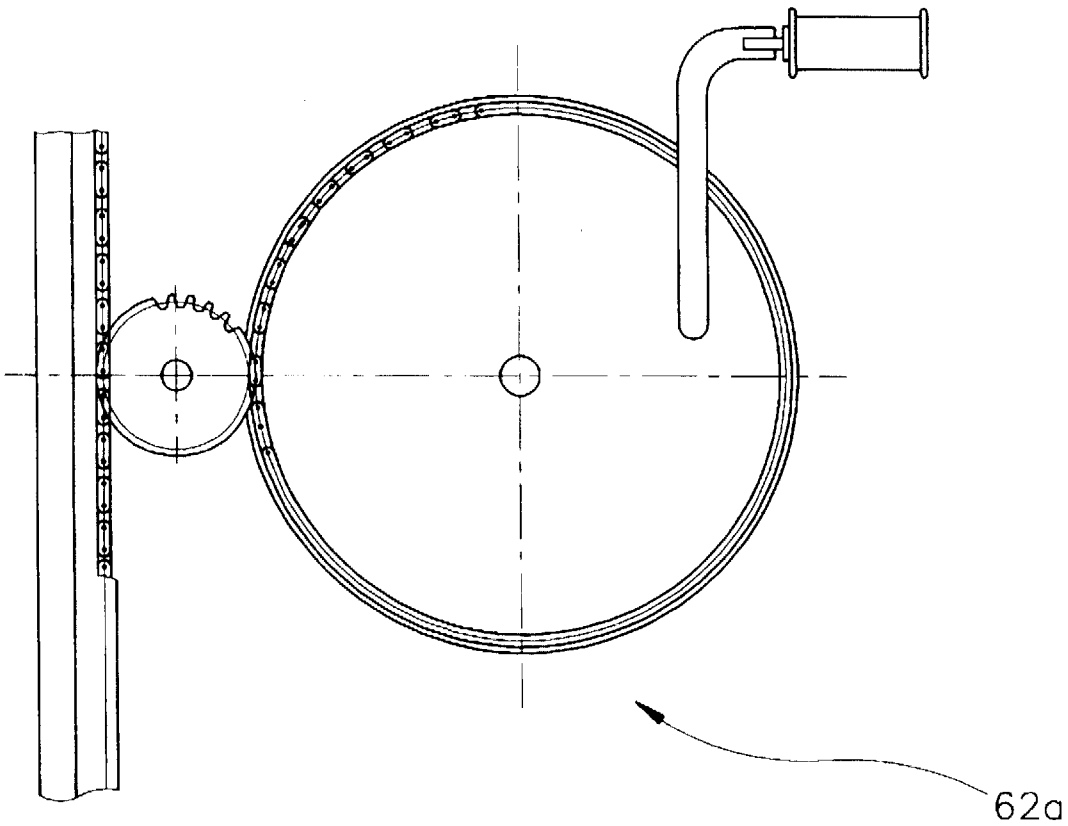
FIG. 11 is a side view of the driving mechanism for stretching the hips, in an embodiment of this invention, where a chain has been substituted for gear teeth.

As shown in FIG. 11, in a further embodiment a driving system **62*a* using chains in the same way is substituted for the driving system 62**.

What is claimed is:

1. A multifunctional training machine, placed on a floor for physical training of a human user, said multifunctional training machine comprising:

a frame, having a longitudinal axis;

a device for bending the body of said user upwards from a lying position, further comprising:

a seat, mounted on said frame and having a front edge and a back edge, said front edge and back edge being placed along said longitudinal axis of said frame, a back rest, hingedly mounted on said back edge of said seat, such that said back rest is raisable and lowerable, a gliding frame, mounted on said frame in front of said seat and being glidable along said longitudinal axis of said frame in a longitudinal movement, said gliding frame having two foot rests for said user, and a transmission mechanism, connected to said gliding frame and said back rest and transforming said longitudinal movement of said gliding frame into raising or lowering of said back rest;

a hip support for stretching the hips of said user, mounted between said seat and said back rest, close to said back edge of said seat, said hip support being vertically movable, so as to raise the hips of said user above said seat; and a pull bar for training the stretching of the feet of said user, said pull bar being connected to said foot rests, wherein said user pulls up said foot rests using said pull bar and presses in a contrary effort the feet on said foot rests.

2. The multifunctional training machine as claimed in claim 1 wherein:

said transmission mechanism of said device for bending the body of said user upward from a lying position further comprises a transmission rod which is connected to said gliding frame, said transmission rod being parallel to said longitudinal axis of said frame, said transmission rod having an upper side and being movable back and forth along said longitudinal axis of said frame, driven by said gliding frame, said transmission rod having a horizontal rack on said upper side thereof, and a gear, shaped as a sector of a disc, attached to said back rest and performing a rotational movement having a common rotational axis with a shaft that serves as a hinge of said back rest, said gear engaging with said horizontal rack;

wherein said user lies on said seat, with said back rest in a low position, and pushes said gliding frame forward, which, by said transmission mechanism, causes said back rest to rise, while said user at the same time raises the body from a lying position.

3. The multifunctional training machine as claimed in claim 2 wherein:

a pinion is inserted between said horizontal rack and said gear, engaging both said horizontal rack and said gear.

4. The multifunctional training machine as claimed in claim 2 wherein:

said machine further includes an elastic device having two ends, a first of said two ends being connected to a front end of said frame, a second of said two ends being connected to said gliding frame or to said transmission mechanism, wherein said elastic device, when said gliding frame is pulled back, develops an elastic counterforce which pushes said gliding frame forward, assisting said user when bending the body upwards from a lying position.

5. The multifunctional training machine as claimed in claim 2 wherein:

said frame and said transmission mechanism have independently adjustable lengths.

6. The multifunctional training machine as claimed in claim 2 wherein:

said back rest has a plurality of rollers with a massaging effect for the back of said user.

7. The multifunctional training machine as claimed in claim 2 wherein:

said gear has two angular limiters for limiting the angular range of said rotational movement of said gear.

8. The multifunctional training machine as claimed in claim 7 wherein:

each said angular limiter comprises a plurality of holes, bored into said gear parallel to said rotational axis thereof; and at least one bolt, inserted into one of said holes;

wherein said bolt extends from said gear parallel to said rotational axis thereof, so as to stop said rotational movement of said gear at a certain angular position, thereby stopping the raising or lowering of said back rest.

9. The multifunctional training machine as claimed in claim 1 wherein:

said transmission mechanism further comprises:

a transmission rod which is connected to said gliding frame and is parallel to said longitudinal axis of said frame, said transmission rod is movable back and forth along said longitudinal axis of said frame and is driven by said gliding frame, a gear, shaped as a sector of a disc with a periphery, attached to said back rest and performing a rotational movement having a common rotational axis with a shaft that serves as a hinge of said back rest, a first chain, attached to an upper side of said transmission rod, a second chain, attached to said periphery of said gear, and a pinion that engages both said first chain and said second chain;

wherein said user lies on said seat, with the back rest in a low position, and pushes said gliding frame forward, which, by said transmission mechanism, causes said back rest to rise, while said user at the same time raises the body from a lying position.

10. The multifunctional training machine as claimed in claim 1 wherein:

said hip support for stretching the hips of said human user further comprises:

a hip rest, having a right end and a left end and a lower side, said hip rest being mounted between said seat and said back rest, close to said back edge of said seat, said hip rest being vertically movable, so as to raise the hips of said user above said seat, and two driving systems connected to said lower side of said hip rest at said right and left ends thereof, each of said two driving systems having a vertical rack and a driving gear that engages said vertical rack;

wherein said user lies on said seat with the back rest in a low position and rotating said driving gear moves said hip rest vertically up and down, thereby stretching and releasing the hips.

11. The multifunctional training machine as claimed in claim 10 wherein:

between said vertical rack and said driving gear a pinion is inserted, said pinion engaging both said vertical rack and said driving gear.

12. The multifunctional training machine as claimed in claim 1 wherein:

a handlebar extending toward said seat is attached to said driving gear so as to allow said user to rotate said driving gear and thus to raise or lower said hip rest.

13. The multifunctional training machine as claimed in claim 1 wherein:

two resetting devices are provided, each of said resetting devices being attached to said upper end of one of said two foot rests, said resetting devices returning said foot rests, after said foot rests have been pulled up, to a lowered position.

* * * * *